United States Patent [19]

Riedel

[11] 4,062,562

[45] Dec. 13, 1977

[54] SKI BRAKE WITH STIRRUP-SHAPED SPRING WIRE AND STRETCHER THEREFOR

[75] Inventor: Tilo Riedel, Eching, Germany

[73] Assignee: S.A. Etablissements Francois Salomon & Fils, Annecy, France

[21] Appl. No.: 665,515

[22] Filed: Mar. 10, 1976

Related U.S. Application Data

[63] Continuation-in-part of Ser. No. 557,476, March 12, 1975, Pat. No. 3,989,271.

[30] Foreign Application Priority Data

| | | |
|---|---|---|
| Mar. 15, 1974 | Germany | 2412623 |
| July 26, 1974 | Germany | 2436155 |
| Feb. 20, 1975 | Germany | 2507371 |

[51] Int. Cl.[2] ..... A63C 7/10

[52] U.S. Cl. ..... 280/605

[58] Field of Search ..... 280/605, 604

[56] References Cited

U.S. PATENT DOCUMENTS

| | | | |
|---|---|---|---|
| 3,884,487 | 5/1975 | Wehrli | 280/605 |
| 3,964,760 | 6/1976 | Riedel | 280/605 |
| 3,989,271 | 11/1976 | Riedel | 280/605 |

*Primary Examiner*—Joseph F. Peters, Jr.
*Assistant Examiner*—David M. Mitchell
*Attorney, Agent, or Firm*—Karl F. Ross

[57] ABSTRACT

A ski brake has a stirrup-shaped bent-wire actuator upon which at least one brake element is mounted for swinging movement into an operative position to limit free flight of a ski released, for example, upon the fall of a skier. The spring wire is deformed when it is held in an inoperative position by the ski boot and springs into its operative position by the restoring force produced by deformation of the spring wire. A stretcher means is provided, e.g. in the form of a toggle, to deform the spring wire to draw its shanks together.

11 Claims, 8 Drawing Figures

SKI BRAKE WITH STIRRUP-SHAPED SPRING WIRE AND STRETCHER THEREFOR

CROSS-REFERENCE TO RELATED APPLICATION

This application is a continuation-in-part of my copending application Ser. No. 557,476 filed Mar. 12, 1975 and entitled "AUTOMATIC BRAKE FOR SKI", now U.S. Pat. No. 3,989,271.

FIELD OF THE INVENTION

The present invention relates to a device for braking the free flight of a ski upon the release thereof from a ski boot, e.g. upon falling of the skier and, more particularly, to a ski brake having a spring-biased actuator tending to swing at least one brake element into an operative position against a restoring force brought about by distortion of a stirrup-shaped spring wire whose bight can be held in an inoperative position by the ski boot.

BACKGROUND OF THE INVENTION

As described more fully in the above-identified application, a ski which is released from a ski boot on a slope can engage in free flight and, at high speeds, poses a danger to other skiers. For this reason it has been proposed to provide a strap or the like to retain the ski on the leg of the skier even if the ski boot should become detached from the ski in a fall or other accident.

It has also been proposed to provide skis with automatic brakes which are retained in their inoperative positions by application of the ski boots against the skis, e.g. against a spring force tending to bias a brake element into an operative position. The actuator may be a spring wire engaged by the toe or heel of the ski boot when the latter is received properly in the ski binding. The actuator is provided with one or two brake elements which can be constituted as blades and swing from their inoperative positions in which they engage the ground and prevent free flight of the ski when the actuator is released by the ski boot.

Such devices are termed hereinafter generically as "ski brakes". As indicated, such ski brakes have an actuator which is biased under a primary spring force from the inoperative position toward the operative position and a mounting plate whereby the brake can be fixed to the upper surface of the ski.

In one such brake, which is mounted behind the binding in a bearing or journal arrangement, the pivot axis includes an acute angle with the longitudinal axis of the ski and the basic spring force is generated by a torsion spring acting upon the blade-like brake element.

In another conventional construction, leaf springs are secured at their forward ends to the ski and at their rearward ends tend to bend upwardly when they are unloaded. Upon loading by the ski boot, these spring elements are urged toward the upper surface of the ski to swing the blades into positions in which they are generally parallel to the ski edges (see Austrian Patent 299,036).

Austrian Patent Nos. 280,867 and 210,804 described other ski brakes which are somewhat more remote from the structure of the present application than even the prior-art devices mentioned above and hence require no detailed discussion.

In another ski brake (see Austrian Pat. No. 305,844) a spring, upon the release of an actuator, rotates a shaft lying transversely of the ski about the axis of the shaft to bring the brake element into its operative position.

A ski brake mounted upon a support plate affixed to the upper surface of a ski is described in German published application (Offenlegungsschrift) No. 2,417,279.

In one recess of this support plate, a round-section wire is pivotally journaled and is formed as a pivot shaft. One end of the circular-section wire forms a brake spur while another region of the wire is bent into a retaining hoop, the free end of the hoop being formed as a second shaft journaled in a further recess of the support plate.

The construction requires that the two journaling recesses in the support plate be exactly parallel, a requirement which increases the fabrication cost and causes differences with respect to mounting or operation if the requirement is not met. The two recesses impart an elastic prestress to the circular-section wire so that the braking spur automatically springs into the operative position when the wire is released by the ski boot.

OBJECTS OF THE INVENTION

It is the principal object of the present invention to develop further the concepts set forth in the above-identified application.

It is another object of the invention to provide an improved ski brake which avoids the disadvantages of the prior-art systems mentioned above.

Still another object of the invention is to provide a simply constructed and inexpensive ski brake which is reliable in operation, cannot be rendered ineffective by icing up and which has no portions that can jam one within another so as to render the brake inoperative.

SUMMARY OF THE INVENTION

These objects and others which will become apparent hereinafter are attained, in accordance with the present invention, in a ski brake having a stirrup-shaped bent spring wire swingably mounted upon the upper surface of the ski and carrying at least one brake element, the wire being deformable upon the pressing of its bight against or toward the ski surface by a ski boot so as to retain the brake in its inoperative position, thereby causing the stored force of the deformation of the spring to swing the brake element into its operative position when the bight of the spring wire is released by the ski boot. The invention resides in providing a ski brake of this type with a stretcher mechanism which, upon pressing of the bight toward the upper surface of the ski, forces the shanks of the bight toward one another.

Advantageously, the stretching device includes a treadle or tread plate which engages the bight of the bent spring wire and is provided with at least one articulation between two portions of the treadle so that the two portions are urged into coplanarity from a mutually angled position, thereby drawing the bight of the spring wire further away from a pivot portion of the latter which can be retained in a mounting plate against which one end of the treadle can engage the bight of the spring wire.

The simplified construction of the ski brake according to the present invention permits reliable operation and allows, by permitting adjustment of the degree of stretching of the stirrup, varying the degree to which the brake elements are swung onto the upper surface of the ski when the tread plate is depressed by the ski boot.

BRIEF DESCRIPTION OF THE DRAWING

The above and other objects, features and advantages of the present invention will become more readily apparent from the following description, reference being made to the accompanying drawing in which.

SPECIFIC DESCRIPTION

Figure 1:
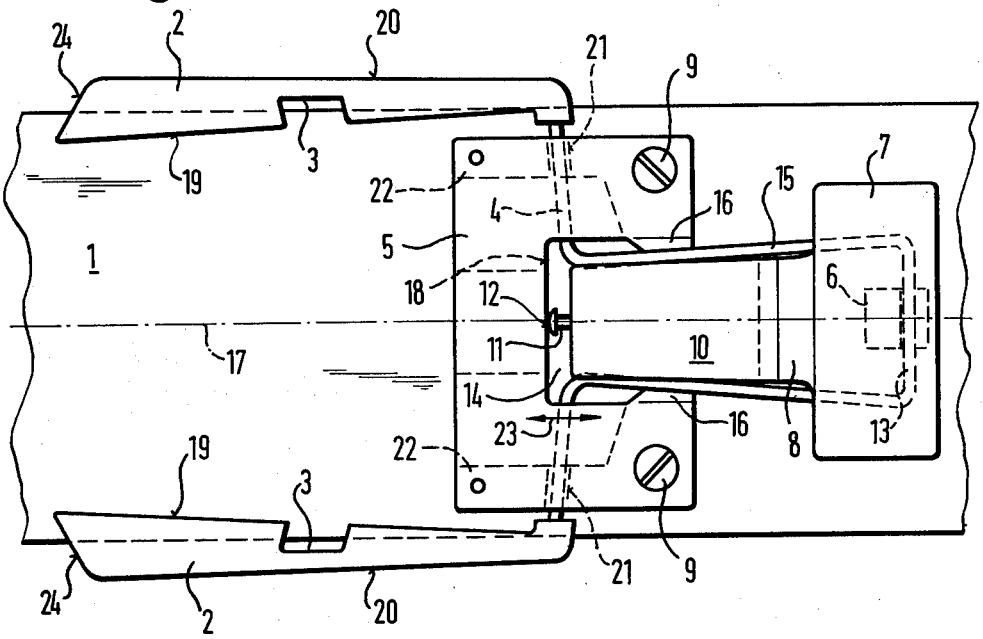
FIG. 1 is a plan view of a ski brake embodying the present invention.
Figure 2:
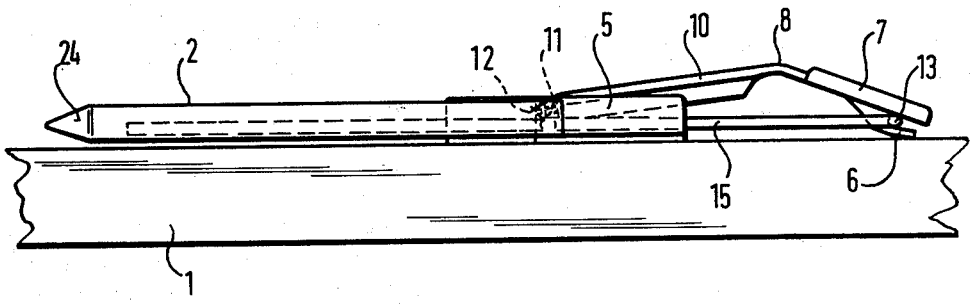
FIG. 2 is a side-elevational view thereof.
Figure 3:
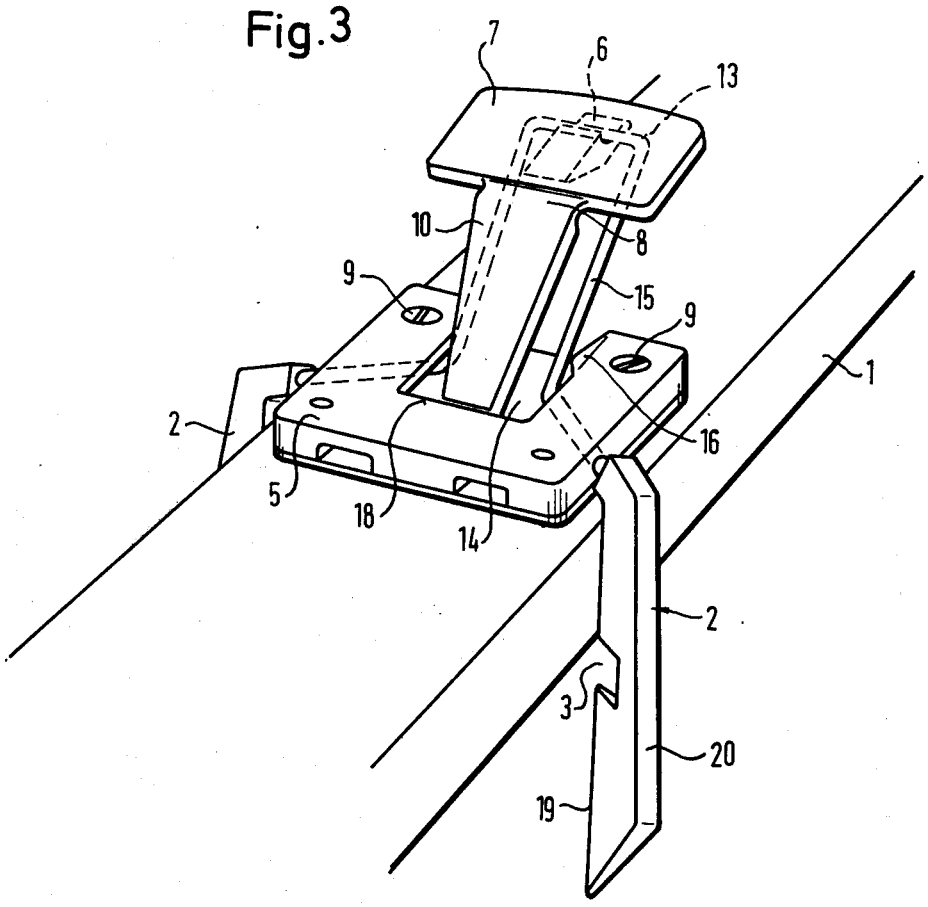
FIG. 3 is a perspective view of the ski brake in its operative position.

The ski 1 shown in FIGS. 1 – 3 has an upper surface upon which a mounting plate 5 is affixed adjustably by screws 9. While the mounting plate in FIGS. 1 – 3 is shown to be of one piece, it can be constructed in other ways if desired. It is, however, desirable that the mounting plate 5 have a pair of lateral passages 21 in which offset portions of a stirrup-shaped spring wire 4 are received. The passages 21 are inclined at acute angles to the longitudinal edges of the skis and serve at the same time as pivot bearings and retaining members for the spring wire 4.

Inwardly of the passages 21, there is formed a wider slot in which the offset portions of the wire can move back and forth as represented by the double-headed arrow 23. This wider slot can be formed directly in the one-piece mounting plate 5 and the underlying plate as described in the aforementioned copending application.

It has also been found to be desirable to provide the passages 21 in a pair of opposite webs or ribs 22 of the mounting plate which extend parallel to the longitudinal edges of the ski and define the flanks of the aforementioned wider slot. The webs or ribs 22 can, if desired, simultaneously form spacers between the upper plate member and a lower plate member of a bipartite mounting plate although, in the embodiment illustrated, they are formed unitarily on the mounting plate 5. The webs 22 have a height which can be approximately equal to the thickness (diameter) of the wire of the stirrup 4.

In the embodiment illustrated the mounting plate can be held by four screws 9 to the upper surface of the ski directly or on a plate which is mounted upon the upper surface of the ski.

The ski brake also comprises a treadle having a tread plate 7 upon which the ski boot must press to retain the ski brake in its inoperative position (FIG. 1) and thereby swing the bight 13 of the stirrup downwardly.

The stirrup carries a pair of brake elements or blades 2 which are affixed to the outer ends of the offset portions of the stirrup and are swung upwardly and inwardly to assume the position shown in FIG. 1 when the tread plate 7 is depressed.

The tread plate 7 is connected by an articulation (elastic zone) 8 to a leg 10 of the treadle which bears via a bearing member 11 against the wall 12 of a recess 18 formed in the mounting plate. Furthermore, a hook 6 on the underside of the mounting plate 7 engages the bight 13.

In the operative position of the brake, the leg 10 and the tread plate 7 include an obtuse angle with one another (FIG. 3). However, when the treadle 7, 8, 10 is depressed (FIG. 2) the bight 13 of the stirrup-shaped wire 4 is swung downwardly to assume the position shown in FIG. 2. Further depression straightens the articulation and draws the bight away from the mounting plate 5, thereby drawing the shanks 15 inwardly and swinging the blades 2 over the longitudinal edges of the ski.

In this position the brake elements 2 do not project below the running surface of the ski and do not lie significantly outwardly thereof. The free extremities of the brake elements can be inclined to include obtuse angles with the longitudinal edges of the ski as shown at 24 in FIG. 1 to deflect stones, roots or the like during normal skiing, thereby reducing the possibility of breakage of the brake. The treadle 7, 8, 10 thus constitutes, in effect, a toggle member which forms a stretching device for the bight of the bent wire stirrup 4.

The bight 13 is formed in one piece with the offset portion of the spring wire 4 and is connected thereto by shanks 15. The hoop 6 opens rearwardly and has a U-configuration so that the bight 13 can be inserted from the rear.

The recess 14 extends rearwardly and has flanks formed with cams 16 which project inwardly and engage the shanks 15 when the bight 13 is depressed toward the upper surface of the ski. These cams stress the spring wire 4 and produce an initial inward movement of the brake elements or blades 2 which is increased by the stretching action described above.

In the embodiment of FIGS. 1 – 3, the bending zone is shown to be a portion formed monolithically with the tread plate 7 and the leg 10 but of a reduced cross section so as to impart a bendable and somewhat elastic characteristic to the synthetic-resin treadle.

Figure 7:
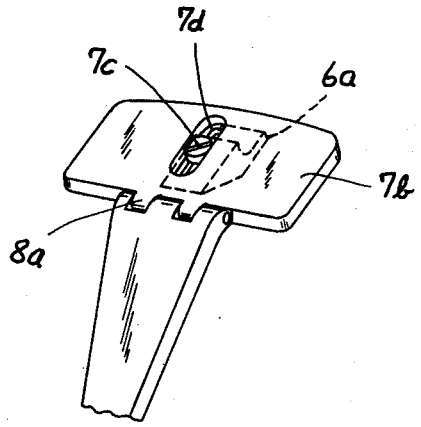
FIG. 7 is a perspective view of another treadle.
Figure 8:
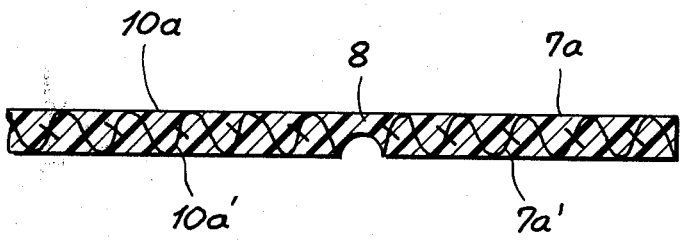
FIG. 8 is a cross section through the treadle of FIGS. 1–3.

In FIG. 7, however, the region **8*a* is shown to be a hinge provided with a pintle. When the leg 10*a* (FIG. 8) and the plate 7*a* are provided with a web-type reinforcement of fabric, mesh, etc. shown at 10*a*' and 7*a*', the bending zone 8** is free from such reinforcement.

The leg 10 is provided with a screw 11 which has a rounded head bearing at 12 along the inner wall of the recess 14. The blades 2 are provided with notches 3.

Figure 4:
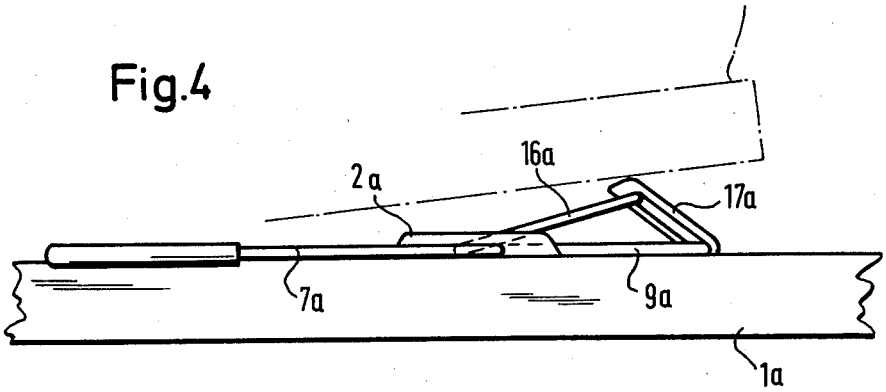
FIG. 4 is a side-elevational view of another embodiment of the invention.
Figure 5:
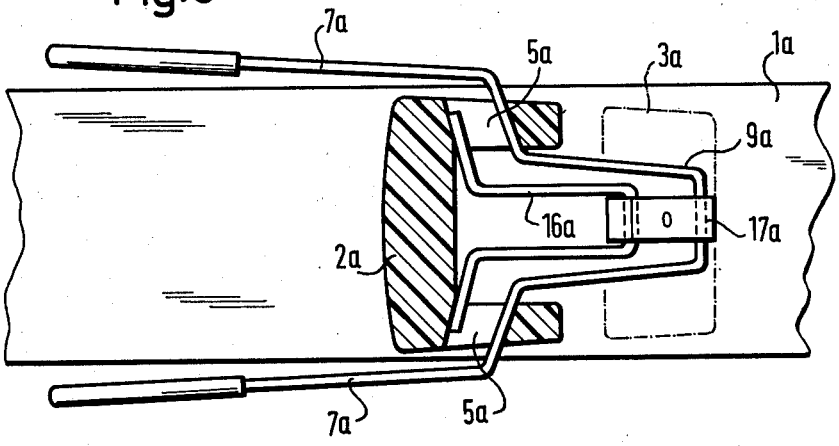
FIG. 5 is a horizontal section through the support plate of the ski brake of FIG. 4.
Figure 6:
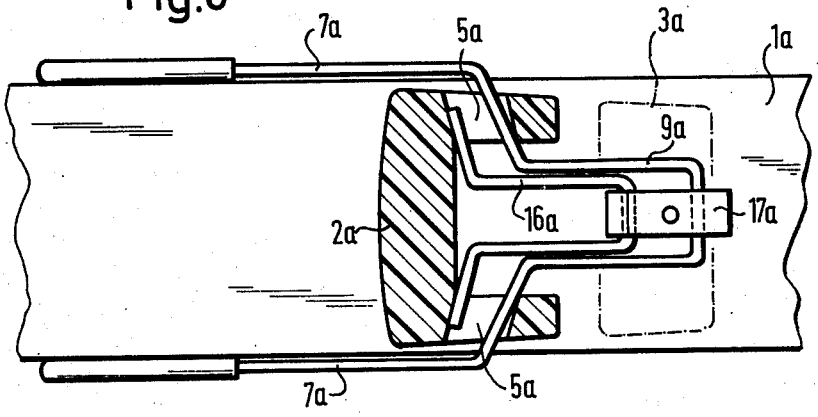
FIG. 6 is a view similar to FIG. 5 but illustrating another position of the device.

In FIGS. 4 – 6, the stretching device is shown to comprise a pressure stirrup **16*a* articulated to a link 17*a* which forms the tread plate or can be provided with a tread plate as shown at 3*a*. As can be seen from FIGS. 4 and 6, the displacement of member 17*a* and member 16*a* into a flat position by the ski boot stretches the bight 9*a* of the stirrup carrying the brake elements 7*a*. Recesses 5*a* are formed in the mounting plate 2*a*** to permit the movement of the two stirrups as illustrated.

In FIG. 7, moreover, I shown an arrangement whereby the holder **6*a* can be adjusted relative to the tread plate 7*b* by a slot 7*c* and a screws 7*d*** to obtain the proper force upon the bight of the actuating stirrup.

To the extent that the structure of the ski brake of the present invention and its mode of operation may require further elucidation, reference may be had to my prior application mentioned above, all of the contents of which are incorporated by reference herein.

I claim:

1. A ski brake for preventing free flight of a ski upon the release thereof from a ski boot, e.g. upon the falling of a skier, comprising:

a mounting plate on the upper surface of said ski;

a stirrup-shaped bent spring wire mounted on said plate upon the upper surface of the ski for swinging movement between an inoperative position wherein a bight of said wire lies substantially along said surface and an operative position wherein said bight is upstanding from said surface;

at least one brake element mounted on said spring wire and adapted to swing from a position wherein it lies along a longitudinal edge of the ski into a position in which it projects below a running face of the ski upon movement of said bight between said inoperative position and said operative position; and stretching means on said ski for stretching said bight upon the movement thereof between said operative position and said inoperative position, thereby drawing said brake element inwardly toward the longitudinal center line of the ski, said stretching means comprising a treadle mounted on said ski and engaging said bight, said treadle comprising a pair of articulated angularly adjoining members, one of said members engaging said bight, the other of said members bearing upon said plate, said treadle being flattenable upon the pressing of a ski boot thereagainst to stretch said bight by displacing the crosspiece of said bight away from said plate.

2. The ski brake defined in claim 1 wherein the member engaging the bight is a tread plate, said members being joined together by an articulation.

3. The ski brake defined in claim 2 wherein said articulation is a hinge.

4. The ski brake defined in claim 2 wherein the articulation and said members are formed unitarily as a single piece.

5. The ski brake defined in claim 2 wherein said tread plate is formed on its underside with a holder engageable with said bight.

6. The ski brake defined in claim 5, further comprising means for adjustably mounting said holder on said tread plate.

7. The ski brake defined in claim 2 wherein said treadle further comprises a leg forming said other of said members, said leg, said tread plate and said articulation being formed of substantially the same material, said tread plate and said leg being provided with stiffening reinforcement, said articulation being free from said reinforcement.

8. The ski brake defined in claim 2, further comprising a screw between said mounting plate and said other member for adjusting the position of said treadle.

9. The ski brake defined in claim 2 wherein said tread plate is engageable by the heel of a ski boot.

10. In a brake for a ski wherein a bent wire is spring-biased in a mounting plate to swing into an operative position upon its release by a ski boot to displace a brake element into a position in which it is transverse to the ski and projects below the lower surface thereof for engagement with the snow, the improvement wherein:

said bent wire is stirrup-shaped and has a U-shaped bight formed with a crosspiece and a pair of shanks carrying respective such brake elements;

a tread plate is connected to said crosspiece and is positioned for engagement by said ski boot to be pressed thereby against the upper surface of the ski; and a stretching means connects said tread plate to said upper surface of said ski and includes a member articulated to bear against said ski and said tread plate and urge said crosspiece away from said mounting plate and stretch said bight upon the pressing of said tread plate toward the upper surface of the ski.

11. The improvement defined in claim 10 wherein each of said shanks has an outwardly extending offset portion received in said mounting plate and swingably retaining said bent wire therein, each of said offset portions terminating at its outer end in a respective one of said brake elements, said member bearing against said mounting plate.

* * * * *

Disclaimer 4,062,562.—*Tilo Riedel,* Eching, Germany. SKI BRAKE WITH STIRRUP-SHAPED SPRING WIRE AND STRETCHER THEREFOR. Patent dated Dec. 13, 1977. Disclaimer filed Mar. 2, 1981, by the assignee, *S. A. Etablissements Francois Salomon & Fils.*

The term of this patent subsequent to June 22, 1993, has been disclaimed.

[*Official Gazette April 7, 1981.*]